United States Patent [19]

Hodler

[11] 4,027,726

[45] June 7, 1977

[54] PRESSURE DIE-CASTING BLOCK WITH A VENTING VALVE

[76] Inventor: Fritz Hodler, 3 Chemin du Chatagny CH 1842, Territet, Switzerland

[22] Filed: June 4, 1975

[21] Appl. No.: 583,665

[30] Foreign Application Priority Data

June 10, 1974 Germany ..... 2427970

[52] U.S. Cl. ..... 164/305; 164/410; 425/812

[51] Int. Cl.[2] ..... B22D 17/20

[58] Field of Search ..... 164/303, 304, 305, 410, 164/137, 341, 61, 253, 254; 425/420, 812

[56] References Cited

UNITED STATES PATENTS

| | | | |
|---|---|---|---|
| 3,349,833 | 10/1967 | Hodler | 164/305 X |
| 3,433,291 | 3/1969 | Hodler | 164/305 |
| 3,690,803 | 9/1972 | Pechtold et al. | 425/326 B |
| 3,773,454 | 11/1973 | Horve et al. | 425/420 X |

FOREIGN PATENTS OR APPLICATIONS

| | | | |
|---|---|---|---|
| 2,248,282 | 4/1974 | Germany | 164/305 |

*Primary Examiner*—Ronald J. Shore
*Assistant Examiner*—Gus T. Hampilos
*Attorney, Agent, or Firm*—Hill, Gross, Simpson, Van Santen, Steadman, Chiara & Simpson

[57] ABSTRACT

A pressure die-casting block wherein two block halves are assembled together along a parting plane to provide an internal cavity. One of the block halves is provided with a venting valve the port of which opens into the parting plane to thus communicate with the cavity. In the assembled condition of the block an end face of the venting valve abuts an end face of the other half block and means are provided whereby these two abutting faces bear upon one another with a force additional to the force holding the two half blocks together.

9 Claims, 6 Drawing Figures

Figure 6:
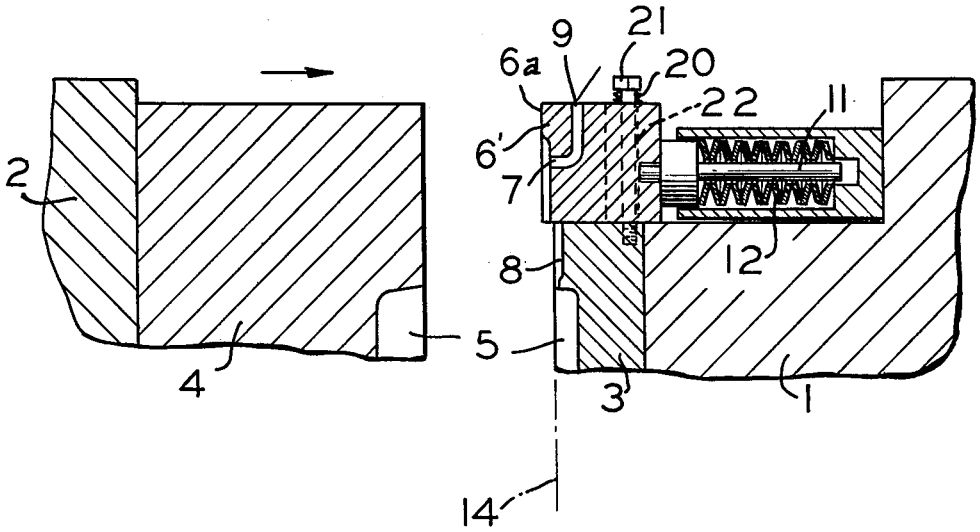

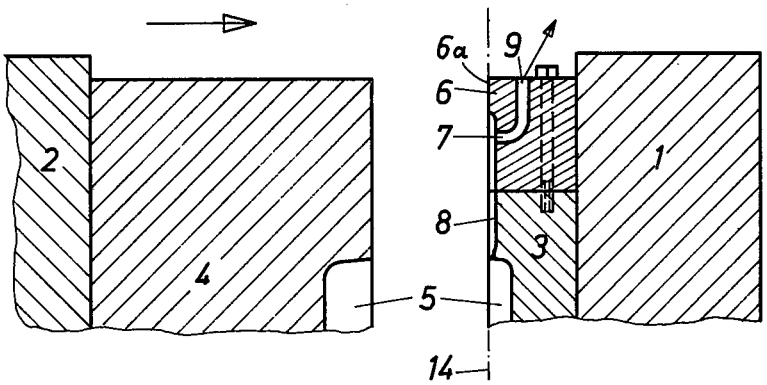
Fig. 1
PRIOR ART
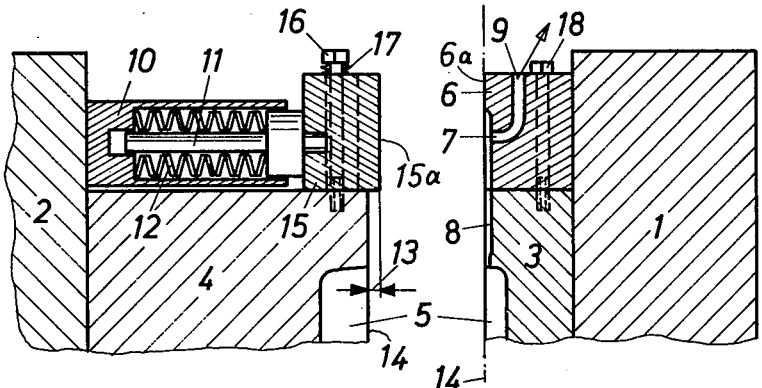
Fig. 2
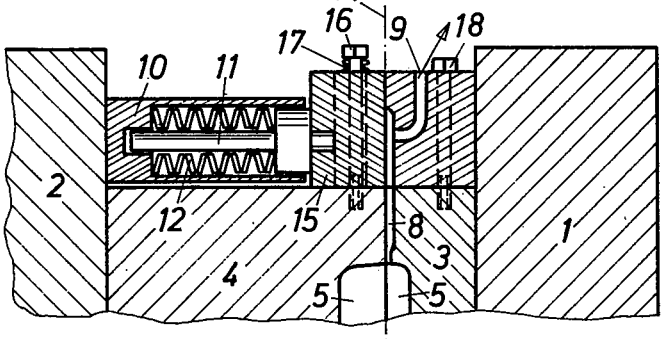
Fig. 3
Fig. 4
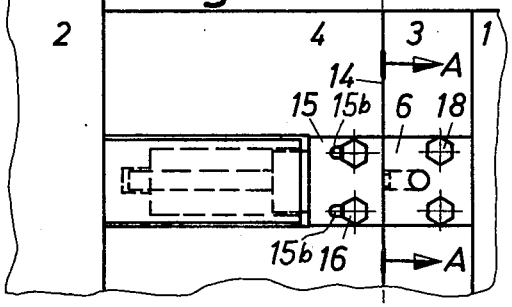
Fig. 5 A-A
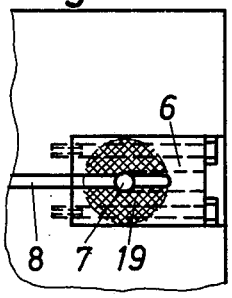

PRESSURE DIE-CASTING BLOCK WITH A VENTING VALVE

The invention relates to a pressure die-casting block with a venting valve disposed in one of the block halves, the venting valve endface with the venting port being situated in the block parting plane.

Pressure die-casting blocks must be vented and to this end are provided with venting valves which are either installed into one casting block half or are screw-mounted on one casting block half to be in flush alignment with the end-face thereof. The endface of the venting valve must be in accurate alignment with the block parting plane of the casting block so that the endface of the valve member bears accurately on the mating surface of the other casting block half after the casting block is closed in order to prevent liquid metal being ejected after the casting operation. Trouble-free casting operation can be maintained for as long as this condition is observed.

However, in the course of the many casting operations, more particularly in the case of large casting blocks, temperature differences at different places of the casting block frequently cause one or the other half thereof to be deformed so that it is no longer possible to ensure reliable closing of the blocks over the entire block parting plane. This causes liquid metal to be ejected between the endface of the venting valve and the mating face of the mating block as the result of which the valve is either damaged or due to adhesion of metal on the endfaces around the valve aperture leads to frequent and costly interruptions of operation.

It is therefore the object of the present invention to avoid this disadvantage and to ensure absolutely reliable closure of the endface of the venting valve and the associated mating face of the other block half even if substantial block deformations are present.

According to the invention, this problem is solved in that the endface of the venting valve and the associated mating face of the other block half bear upon each other under a prestressing force when the block is closed.

The system according to the invention therefore represents a compensator which prevents detrimental effects acting on the venting valves of pressure die-casting blocks due to temperature-dependent deformation of such pressure die-casting blocks. The system reliably prevents liquid metal being ejected in the region of the venting valve, greatly reduces the risk of accidents and permits efficient operation.

An embodiment of the invention is disclosed in the description hereinbelow by way of example taken with reference to the accompanying drawings, in which:

FIG. I is an open casting block in sectional form with a known arrangement of a venting valve;

FIG. II shows an embodiment of a die-casting block according to the invention in section and in an opened position;

FIG. III shows the pressure-die-casting mould according to FIG. II in a closed position;

FIG. IV is a plan view of the pressure die-casting block of FIG. III; and

FIG. V is a view along the line A—A of FIG. IV.

FIG. VI is a view of an alternate embodiment having a movable valve member.

FIG. 1 shows in diagrammatic form a section of a known pressure die-casting machine, the numeral 1 referring to a fixed platen, the numeral 2 to a movable block platen, the numeral 3 to a stationary block half, the numeral 4 to a movable block half, the numeral 5 to block cavities, the numeral 6 to a venting valve member which can be screw-mounted on the block-half 3, and the numeral **6*a* refers to an endface of the venting valve member, the numeral 7 relates to a venting port, the numeral 8 to a venting duct extending from the block cavity 5 to the venting port 7 of the valve and the numeral 9** refers to a discharge aperture.

FIG. II shows in diagrammatic form a section of an embodiment of a pressure die-casting block according to the invention having reference numerals which correspond to those of FIG. I. In the drawing, a mating member 15, which is slightly slidable perpendicularly with respect to the block parting plane, is mounted opposite a venting valve assembly 6 on a fixed block half 3 by being screw-mounted on a movable block half 4 by means of screw fasteners 16 which are guided by means of spring washers 17 in slotted holes **15*b*. The mating member 15 is under the action of a spring system comprising a casing 10, a piston 11 and a spring stack 12 so that when the casting block is open that mating face 15*a* of the mating member 15 associated with the endface 6*a* of the venting valve member 6 is situated opposite the block parting plane 14 of the block half 4 at a distance 13. Conveniently, the distance 13 is approximately 0.1 cm. When the casting block is closed (see FIG. III), the resulting rearward motion of the mating member 15 causes the spring 12 to be compressed to produce a prestressing force so that the mating face 15*a* of the mating member 15 and the endface 6*a* of the venting valve 6 always bear upon each other in sealing-tight manner even if one or the other block halves 3 or 4** becomes deformed by approximately 0.03 cm as the result of temperature differences or due to other effects.

FIG. IV shows a top view of the pressure die-casting block according to FIG. III in the closed position.

FIG. V is a view along the line A—A of FIG. IV, a region 19 shown in broken lines representing the zone endangered by the ejection of liquid metal but without the system according to the invention.

FIG. VI illustrates an alternate embodiment of this invention in which a movable venting valve member 6' is provided instead of the fixed position valve member 6 of FIG. 2. The movable valve member 6' is attached to fixed block half 3 by a screw fastener 21 having a spring washer 20 and slots 22 such that the valve member 6' may translate laterally as described above in relation to FIGS. 2 through 5. A piston 11 is provided on block 1 in a fashion similar to that described with respect to FIG. 2.

In either of the above embodiments, the spring stack is prestressed in such a way that the prestressing force produced thereby is greater than the product of the duct surface area and the pressure of liquid metal acting thereat during a casting operation, even if the block is substantially deformed in the prestressing stroke with the spring stack and prestressing force is therefore reduced.

I claim:

1. A pressure die-casting block in which a casting operation is performed in an internal cavity thereof, said block comprising two block halves assembled together along a plane defining a parting plane of the block, the parting plane passing through said cavity, a venting valve mounted on one of the block halves and having a venting port communicating with the cavity along the parting plane, an independent mating means mounted on another of the block halves, said venting valve having an end face which abuts an end face of the independent mating means, said mating means being mounted on the other of said block halves and being independently moveable from the block halves, and means associated with the mating means for providing a prestressing force tending to hold said abutting faces together in the assembled condition of the half blocks, which force is independent of and additional to that force holding the block halves together in said assembled condition.

2. A pressure die-casting block according to claim 1 wherein said independent mating means comprising a mating member provided on the block half other than the block half with the venting valve, and arranged so as to be movable in the direction which is perpendicular to the block parting plane, said mating member being biased by the action of a spring so that the mating member projects the block parting plane when the block is in a disassembled condition and is thrust back into the block parting plane under the stress of the spring when the block is in the assembled condition.

3. A pressure die-casting block as claimed in claim 1 wherein said venting valve is mounted for movement in a direction perpendicular to the block parting plane and is biased by the action of a spring so as to project beyond the block parting plane when the block is in a disassembled condition and is retracted into the block parting plane when the block is in the assembled condition.

4. A pressure die-casting block according to claim 2 wherein screw means is provided for lightly and resiliently screw-mounting the mating member upon its respective block half, slotted bars being provided in said mating member to guide said screw means with the aid of spring washers.

5. A pressure die-casting block according to claim 3 wherein screw means is provided for lightly and resiliently screw-mounting the venting valve upon its respective block half, slotted bores being provided in said venting valve to guide said screw means with the aid of spring washers.

6. A pressure die-casting block according to claim 4, wherein a spring system is arranged to act on the mating member, said spring system comprising a casing with a spring stack which is supported therein and is guided by a piston.

7. A pressure die-casting block according to claim 5 wherein a spring system is arranged to act on the venting valve said spring system comprising a casing with a spring stack, which is supported therein and is guided by a piston.

8. A pressure die-casting block according to claim 6 wherein the spring stack is prestressed in such a way that the prestressing force produced thereby is greater than the product of the duct surface area and the pressure of liquid metal acting thereat during a casting operation even if the block is substantially deformed and the prestressing stroke of the spring stack and prestressing force is therefore reduced.

9. A pressure die casting block according to claim 7 wherein the spring stack is prestressed in such a way that the prestressing force produced thereby is greater than the product of the duct surface area and the pressure of liquid metal acting thereat during a casting operation even if the block is substantially deformed and the prestressing stroke of the spring stack and prestressing force is therefore reduced.

* * * * *